US005917415A

United States Patent [19]

Atlas

[11] Patent Number: 5,917,415

[45] Date of Patent: Jun. 29, 1999

[54] PERSONAL MONITORING AND ALERTING DEVICE FOR DROWSINESS

[76] Inventor: Dan Atlas, P.O. Box 271, Hod Hasharon 45102, Israel

[21] Appl. No.: 08/891,445

[22] Filed: Jul. 10, 1997

[30] Foreign Application Priority Data

Jul. 14, 1996 [IL] Israel ..... 118854

[51] Int. Cl.[6] ..... G08B 23/00

[52] U.S. Cl. ..... 340/575; 340/539; 340/576; 340/693.5; 600/372

[58] Field of Search ..... 340/576, 575, 340/539, 693.5; 128/903; 600/300, 372, 502–504, 552, 546, 549

[56] References Cited

U.S. PATENT DOCUMENTS

| | | | |
|---|---|---|---|
| 4,210,905 | 7/1980 | Coons | 340/575 |
| 4,496,938 | 1/1985 | Seko et al. | 340/576 |
| 4,509,531 | 4/1985 | Ward | 600/549 |
| 4,665,385 | 5/1987 | Henderson | 340/539 |
| 4,725,824 | 2/1988 | Yoshioka | 340/575 |
| 4,819,860 | 4/1989 | Hargrove et al. | 128/903 X |
| 4,836,219 | 6/1989 | Hobson et al. | 340/575 X |
| 4,928,090 | 5/1990 | Yoshimi et al. | 340/575 |
| 4,967,186 | 10/1990 | Ludmirsky et al. | 340/575 |
| 5,012,226 | 4/1991 | Love | 340/576 |
| 5,195,606 | 3/1993 | Martyniuk | 180/272 |
| 5,404,128 | 4/1995 | Ogino et al. | 340/576 X |
| 5,570,698 | 11/1996 | Liang et al. | 340/575 X |
| 5,583,590 | 12/1996 | Clupper | 340/573 X |
| 5,585,785 | 12/1996 | Gwin et al. | 340/575 |
| 5,626,145 | 5/1997 | Clapp et al. | 128/731 |
| 5,691,693 | 11/1997 | Kithil | 340/576 X |

*Primary Examiner*—Thomas Mullen

[57] ABSTRACT

A wrist worn device and method for monitoring and alerting the user of increased drowsiness. The device includes sensors for monitoring several physiological parameters of the user, including peripheral pulse rate variability, peripheral vasomotor response, muscle tone, peripheral blood flow and reaction time variability. If the majority of these parameters are indicative of increased drowsiness, and audio-visual alert is provided the user. The sensors are encased in a shock-absorbing unit and wirelessly transmit the sensed data.

4 Claims, 2 Drawing Sheets

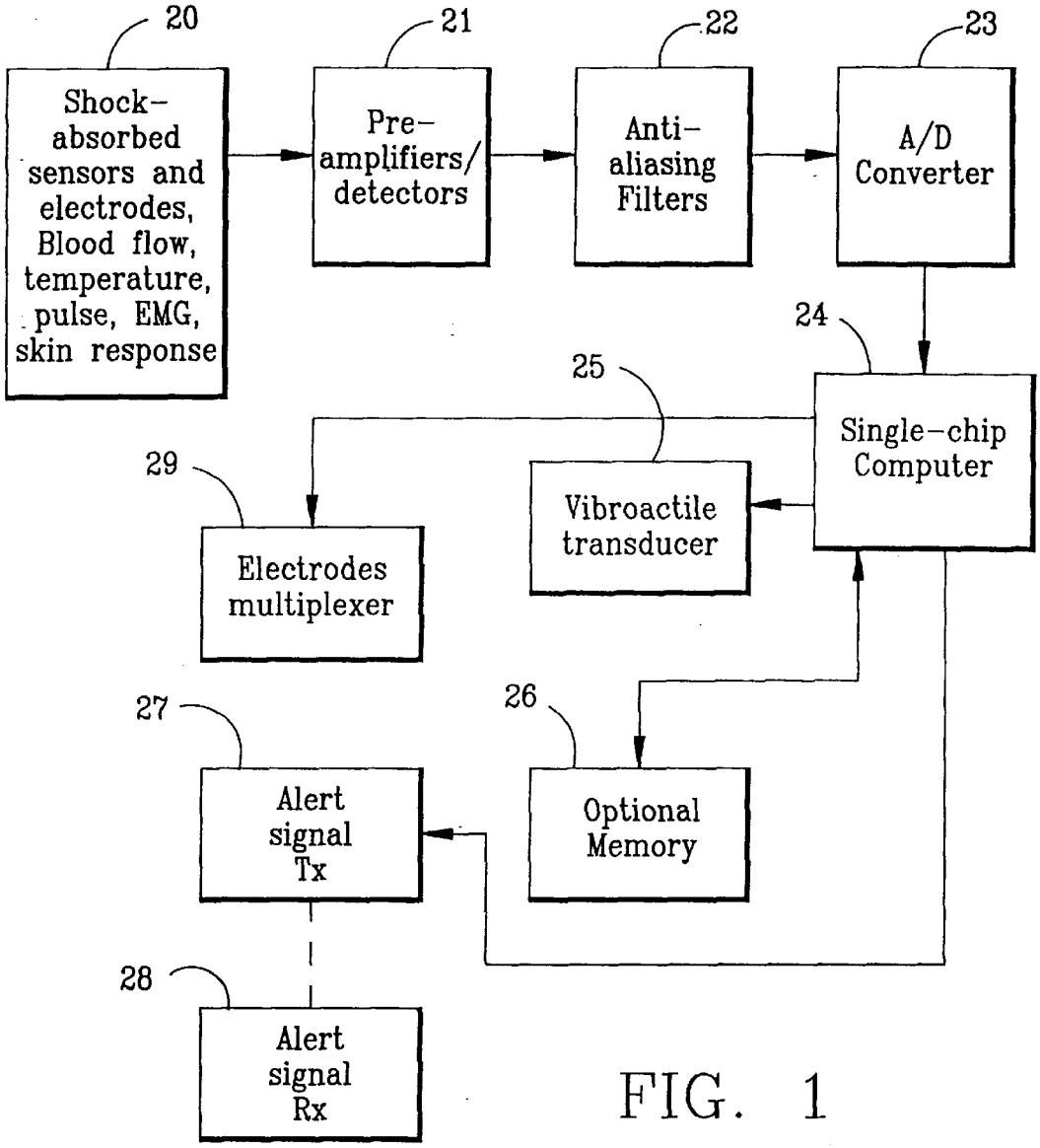
FIG. 1
FIG. 3
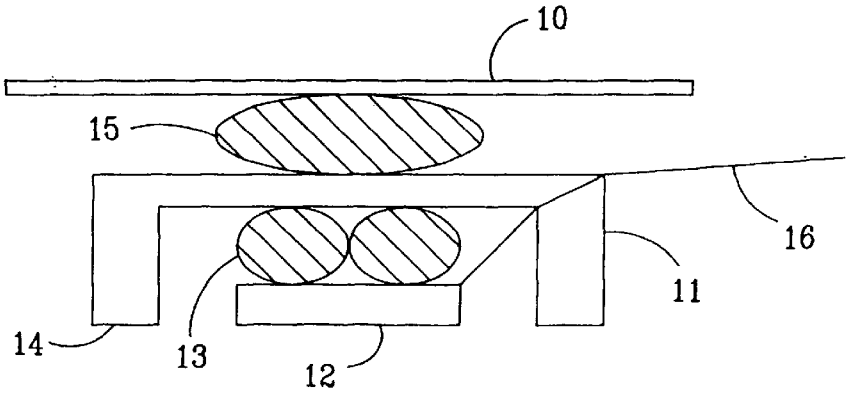

PERSONAL MONITORING AND ALERTING DEVICE FOR DROWSINESS

FIELD AND BACKGROUND OF THE INVENTION

The present invention relates to methodology and wrist-worn apparatus for the early detection of increasing drowsiness in order to alert the person that needs to stay awake and possibly others in the near vicinity.

The state of increasing drowsiness is manifested in a number of physiological changes. The device implemented by this invention combines autonomic and central nervous system electro-physiological monitoring together with automatic reaction time testing.

This invention is particularly useful in safety and security application, examples of which include users such as drivers, pilots, flight controllers night shift workers and ambush soldiers. This invention is then applicable whenever drowsiness must be detected as it can otherwise lead to accidents with dire consequences.

To enable both a practical and effective apparatus, this invention transcends traditional methods that analyze brain waves, eye movements, steering wheel movements and other means published.

This invention may also be used as adjunct monitoring in sleep laboratory or home sleep monitoring, in depth of anesthesia monitoring, and in various diagnostic monitoring, with a memory module attached.

BRIEF SUMMARY OF THE INVENTION

An object of the present invention is to provide an improved methodology and apparatus for the physiological monitoring and alerting for events of increasing drowsiness, which do not require any sensors or electrodes whatsoever (IR, EEG, EOG, etc.) to be affixed to the person's head. It additionally obviates the need to wire the person to any external devices since the device is self-contained and the alert signal output is wireless.

This makes the apparatus and method particularly useful in the above mentioned applications, as well as in a wide variety of other applications.

According to the present invention, there is provided a wrist-belt, comprising the sensors, transducers, energy source and computing power to detect an event of increasing drossiness and transmit an alert flag upon such detection via a wireless link to an audio-visual alarm unit.

The major advantage of the present invention is the absence of head-mounted electrodes and sensors. Particularly, brain waves and eye movements are traditionally measured with electrodes that require gel or paste to be applied for making a good electrical contact, and further require mechanical or adhesive means for holding such electrodes in place. The minute EEG signals are prone to interfering signals arising from wire movements. While the use of gel can be eliminated by the dry, shock-absorbing electrode mounting scheme outlined herein for the limb electrodes, the application of electrodes and lead wires to the scalp will result in an unsightly appearance that will deter the typical user-driver, pilot, soldier, worker, etc. from using the device Further EEG brainwaves signals are generally contaminated by EOG eye movement signals that act as interfering signals, and special algorithms are needed with substantial computer power to remove such interfering signals before further EEG analysis of the brainwaves can be made.

The monitoring from the limbs is a major advantage for more reasons. The device is self-contained, having no wires to tangle with. No wires also means cleaner signals in the hostile environment of radio frequency interference. Wireless operation and limb attachment with Velcro mean user's convenience.

The parameters monitored are analog signals in nature. They are amplified, filtered, and converted into a digital format for further processing by the embedded single chip computer. For each parameter an individualized baseline is computed and stored in RAM memory. A trending is performed on each parameter. When the trended value divided by the baseline deviates from a preset percentage value stored in memory, a parameter alert flag is raised.

To transmit an overall alert flag the device makes a decision based on majority parameter alert flags raised.

The first parameter alert flag identifies the violation of peripheral pulse rate variability preset The pulse is sensed by a semi-conductor sensor, then amplified, filtered, converted from analog to digital and analyzed by the computer for beat-to-beat validity following software dicrotic notch detection. Extraneous pulses are rejected by the algorithm. The pulse rate variability is performed by spectral analysis of the beat-to-beat period. Increasing drowsiness is accompanied by decreasing pulse rate and variability thereof.

The second parameter alert flag identifies the violation of peripheral vasomotor response preset. The high-resolution skin temperature is sensed by a miniature bead thermistor, then amplified, filtered, converted from analog to digital and analyzed by the computer for peak-to-peak amplitude. Extraneous waveforms are rejected by the algorithm. Increasing drowsiness is accompanied by decreasing vasomotor tone variability due to the sympathetic mediation.

The third parameter alert flag identifies the violation of muscle tone preset. The forearm EMG is detected by the wrist electrodes. The EMG signal is amplified, filtered, converted from analog to digital and analyzed by the computer following software rectification and integration for peak and average amplitudes. Increasing drowsiness is accompanied by decreasing muscle tone and muscle tone variability thereof.

The fourth parameter alert flag identifies the violation of peripheral blood flow presets The limb's blood flow is sensed from the electrical impedance of wrist band electrodes. The signal is amplified, filtered, detected, rectified and converted from analog to digital and levels are analyzed by the computer. Increasing drowsiness is accompanied by decreasing blood floss due to decreasing systolic blood pressure.

The fifth parameter alert flag identifies the violation of reaction time. Vibrotactile stimulation is automatically and periodically performed by a miniature concentric motor. The above mentioned electrodes are periodically switched by a multiplexer so as to sense the skin potential response between any two points on the wrist characterized by an area rich in sweat glands measured against an area more devoid of same. The skin potential response signal is amplified, filtered, polarity detected, and converted from analog to digital and levels, polarity and delay following vibrotactile excitation are analyzed by the computer. Increasing drowsiness is accompanied by increasing reaction time as well as increasing tactile sensory and autonomic arousal thresholds.

Above mentioned electrodes and sensors are dry (pasteless). Special means are provided by present invention to assure shock absorption capabilities to sensors and electrodes, in order to enable reliable detection of minute signals with minimal mechanically-induced movement artifacts. Each shock absorber mechanically isolates a sensor or electrode with two independent suspensions, placing a constant pressure on the sensor or electrode which varies as a only one part in several hundreds as result of wrist, movement and varying accelerations. The first order mechanical buffering is provided by a spring that suspends each sensor or electrode in an inverted cup that buffers the sensor or electrode from the surrounding skin. The second order mechanical buffering is provided by an air-cuff that closes around the wrist with Velcro type closure that further suspends the inverted cups.

A wireless communication link is provided to a further remote apparatus that provides an audio-visual alert signal for the detection of increasing sleepiness. The remote apparatus contains a clock and provides an optional periodic "rest" audio-visual reminder signal during the "red" hours when drowsiness may be at its peak. It further serves as a recorder with PC download capability to record and identify the various flags by coding each one uniquely.

BRIEF DESCRIPTION OF THE DRAWINGS

FIG. 1 depicts the preferred embodiment of the device as a block diagram of the hardware components, constructed in accordance with the intention.

FIG. 3 depicts the shock absorber provided each sensor or electrode.

DESCRIPTION OF THE PREFERRED EMBODIMENT

Figure 2:
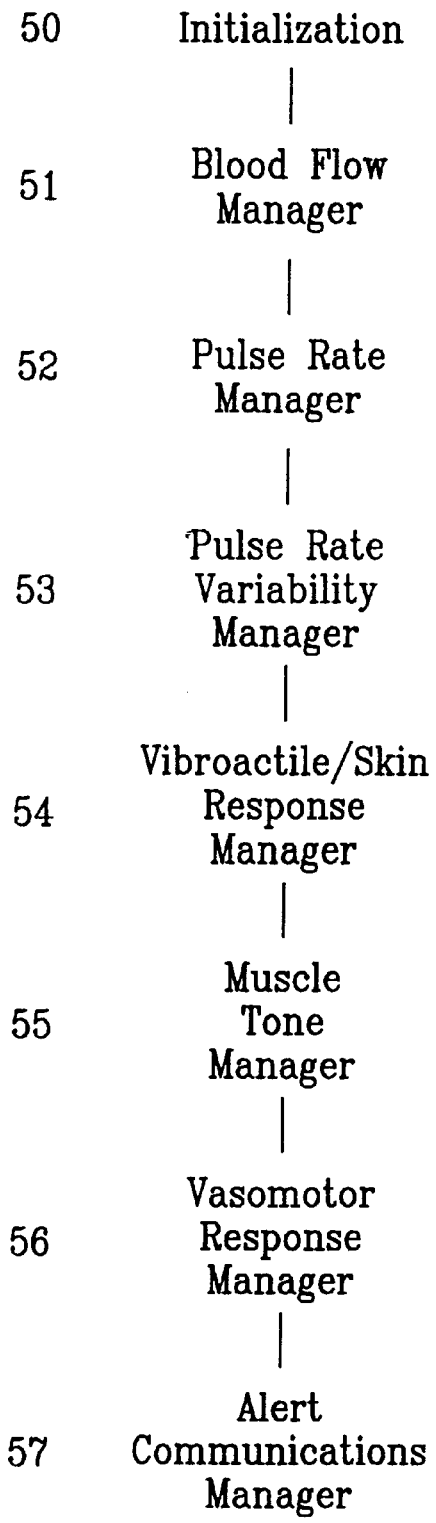
FIG. 2 depicts the software modules of the preferred embodiment of the device.

With reference to FIG. 1, there is illustrated one form of the device constructed in accordance with the invention as preferred embodiment. As indicated earlier, the device contains a set of shock-absorbed sensors and electrodes 20 that measure the blood flow through electrical impedance, temperature through a miniature thermistor bead, pulse through a solid state sensor, EMG (muscle tension) and SPR (skin potential response) through electrodes.

The signals are further amplified, filtered and detested 21. Signals are then fed into anti-aliasing filters 22 before being converted into digital format by A/D converter 23. The digital signal processing is implemented by the single chip computer 24.

The computer generates the first parameter alert flag whenever it identifies the violation of peripheral pulse rate variability preset. The pulse is analyzed by the computer for beat-to-beet validity following software dicrotic notch detection. Extraneous pulses are rejected by the algorithm. The pulse rate variability is performed by spectral analysis of the beat-to-beat period.

The computer generates the second parameter alert flag whenever it identifies the violation of the peripheral vasomotor response preset. The high-resolution skin temperature is analyzed by the computer for peak-to-peak amplitude. Extraneous waveforms are rejected by the algorithm.

The computer generates the third parameter alert flag whenever it identifies the violation of muscle tone preset. The forearm, EMG such as grip is analyzed by the computer following software rectification and integration for peak and average amplitudes.

The computer generates the fourth parameter alert flag whenever it identifies the violation of peripheral blood flow preset. The limb's blood flow is sensed from the electrical impedance of wrist band electrodes. The signal is amplified, filtered, detected, rectified and converted from analog to digital and levels are analyzed by the computer The computer generates the fifth parameter alert flag whenever it identifies the violation of reaction time. Vibrotactile stimulation 25 is automatically and periodically performed by a miniature concentric motor. The above mentioned electrodes are periodically switched by a multiplexer 29 so as to sense the skin potential response SPR between any two points on the wrist. Levels, polarity and delay following vibrotactile excitation are analyzed by the computer.

With reference to FIG. 2, there is illustrated one form of the device software modules flow of the invention when constructed as preferred embodiment. Following power-up, initialization 50 takes place. The blood flow manager 61 is responsible for conversion and analysis of blood flow. The pulse rate manager 52 is responsible for the pulse detection algorithms, pulse validation and artifact rejection, The pulse is further analyzed for spectral variability contents by the pulse-rate-variability manager 53. The reaction time measurement is provided for by the vibrotactile/skin response manager 54 Muscle manager 55 handles the EMG algorithms while vasomotor response manager 56 handles the surface thermometry. Finally, the alert communications manager 57 handles the wireless serial transmission by sending a general alarm flag and optionally a series of flags that identify each and every unique flag activated.

With reference to FIG. 3, there is illustrated one form of the device's shock absorbers provided each electrode or sensor. The upper device surface 10 is where the wrist belt closes with Velcro type material. The electrode or sensor 12 is mechanically buffered inside an inverted cup housing 11. A first order shock absorbing spring or air cushion 13 is placed between the electrode or sensor and the inner top of the cup. The cup comes to rest on the skin at the lowest flange 14. A second order shock absorbing air cushion 15 is placed between the upper device surface and the outer top of the cup. Cable 16 connects the sensor or electrode in each such housing to the rest of the system.

Although the invention has been described in detail for the purpose of illustration, it is to be understood and appreciated that such detail is solely and purely for the purpose of example, and that other variations, modifications and applications of the invention can be made by those skilled in the art without departing from the spirit and scope of the invention.

What is claimed is:

1. A method of monitoring and analyzing the electrophysiological variables of peripheral pulse rate variability, peripheral vasomtor response, muscle tone, and peripheral blood flow for identifying increasing drowsiness and creating alert flags raised by each and every parameter violating a preset ratio of trended value divided by its baseline; said method comprising the steps of providing a first parameter alert flag for identifying the violation of peripheral pulse rate variability preset; providing a second parameter alert flag for identifying the violation of peripheral vasomotor response preset; providing a third parameter alert flag that identifies the violation of muscle tone preset; providing a fourth parameter alert flag that identifies the violation of peripheral blood flow presets; providing a fifth parameter alert flag that identifies the violation of reaction time variability preset; and generating an overall alert flag upon a majority of parameter flags being raised.

2. A wrist worn apparatus for monitoring and analyzing elecrtophysiological variables to detect the onset of drowsiness, comprising sensor means for sensing the peripheral pulse rate; peripheral vasomotor response; muscle tone; peripheral blood flow and reaction time variability; and providing a parameter alert flag whenever a variable exceeds a preset threshold; and means for generating an overall alert flag upon a majority of parameter alert flags being raised.

3. An apparatus according to claim 2 further including shock absorber means provided to assure shock absorption capabilities to said sensors; wherein said shock absorber mechanically isolates said sensors with two independent suspensions, placing a constant pressure on said sensors with a first order mechanical buffering provided by a spring of an air cushion that suspend each sensor in an inverted cup that buffers the sensor from the surrounding skin and with the second order mechanical buffering provided by an air-cuff, spring or air cushion that closes around the wrist and further suspends the inverted cup and de-couples the sensors from mechanical disturbance.

4. An apparatus according to claim 2 further including a wireless communications link for providing an audio-visual alert signal upon the detection of increasing drowsiness.

* * * * *